US010524523B1

(12) United States Patent
Lombard

(10) Patent No.: US 10,524,523 B1
(45) Date of Patent: Jan. 7, 2020

(54) DOUBLE-STRAP HAND WRAPPING APPARATUS AND METHOD OF USE

(71) Applicant: Champ Wraps LLC, Boca Raton, FL (US)

(72) Inventor: Hector Lombard, Boca Raton, FL (US)

(73) Assignee: CHAMP WRAPS, LLC, Boca Raton, FL (US)

( * ) Notice: Subject to any disclaimer, the term of this patent is extended or adjusted under 35 U.S.C. 154(b) by 0 days.

(21) Appl. No.: 16/329,194

(22) PCT Filed: Jul. 9, 2018

(86) PCT No.: PCT/US2018/041323

§ 371 (c)(1),
(2) Date: Feb. 27, 2019

(87) PCT Pub. No.: WO2019/010499

PCT Pub. Date: Jan. 10, 2019

Related U.S. Application Data

(60) Provisional application No. 62/529,987, filed on Jul. 7, 2017.

(51) Int. Cl.
*A41D 13/08* (2006.01)
*A63B 71/14* (2006.01)

(52) U.S. Cl.
CPC ..... *A41D 13/087* (2013.01); *A41D 13/088* (2013.01); *A63B 71/145* (2013.01); *A41D 2600/10* (2013.01); *A63B 2244/102* (2013.01)

(58) Field of Classification Search
CPC ..... A63B 71/145; A63B 2244/102; A41D 13/088; A41D 13/087; A41D 2600/10
See application file for complete search history.

(56) References Cited

U.S. PATENT DOCUMENTS

| | | | | |
|---|---|---|---|---|
| 6,013,044 | A | 1/2000 | Estwanik | |
| 6,093,165 | A * | 7/2000 | Estwanik | A63B 71/145 2/161.7 |
| 6,119,267 | A | 9/2000 | Pozzi | |
| 2005/0066404 | A1 | 3/2005 | Barker | |
| 2016/0367881 | A1 | 12/2016 | Le et al. | |

* cited by examiner

*Primary Examiner* — Anna K Kinsaul
(74) *Attorney, Agent, or Firm* — Mark C. Johnson; Johnson | Dalal

(57) ABSTRACT

A padded double-strap hand wrapping apparatus and method of wrapping the hands prevents injury to the knuckle, hand, and wrist areas, resulting in a supportive and protective hand wrap which can be used in conjunction with boxing and bag gloves. The hand wrapping apparatus is operable along a wrapping path by wrapping the knuckles inside a resilient wrap body having a padded insert fabricated from a deformably resilient material. The fingers are inserted inside a correspondingly sized finger retention members that couple to the upper end of the wrap body. A left and right strap, connected at their proximal ends to the wrap body, are wrapped at a desired tautness to achieve a compression against the hand. The straps form an orthogonal relationship that reinforces the wrapping around the wrist, knuckles, and wrap body. Left and right strap fasteners securely fasten the corresponding strap after wrapping around the hand.

18 Claims, 10 Drawing Sheets

DOUBLE-STRAP HAND WRAPPING APPARATUS AND METHOD OF USE

CROSS REFERENCE OF RELATED APPLICATIONS

This application is a national stage filing of International Application Number PCT/US18/41323, filed Jul. 9, 2018, which claims the benefits of U.S. provisional application No. 62/529,987, filed Jul. 7, 2017, and entitled MULTI-FUNCTIONAL DEVICE, which provisional application is incorporated by reference herein in its entirety.

FIELD OF THE INVENTION

The present invention relates generally to hand wrapping apparatuses and, more particularly, relates to a hand wrapping apparatus with two straps and finger retention members.

BACKGROUND OF THE INVENTION

Typically, a hand wrap is a strip of cloth used by boxers to protect the hand and wrist against injuries induced by punching. It is wrapped securely around the wrist, the palm, and the base of the thumb, where it serves to both maintain the alignment of the joints, and to compress and lend strength to the soft tissues of the hand during the impact of a punch.

Often, participants involved in boxing and martial arts-related sports, wear hand and wrist protection under larger boxing or bag gloves for additional protection and support. This protection is commonly called a hand wrap. Traditional hand wraps are made of cotton or canvas material, and are several feet in length. The participant will tightly wrap this material around his or her knuckles, hands, and wrists. Such hand wraps help prevent serious injury to hands during full contact professional or amateur fighting if they are administered and used correctly.

Typically, long cloth hand wrap are worn underneath a glove. However, the hand wrap can become dirty and discolored almost immediately when used. Thus, the long cloth wrap requires frequent cleaning. Further, it is difficult to maintain the hand wrap in its shape and manageability unless it is tightly rolled when not in use. Moreover, if the traditional hand wrap is not wrapped about the hand and wrist properly, it can become loose and unravel. This loosening lessens, and may even eliminate, the protection to the hands and wrists.

It is known in the art that donning the hand wrap on the hands can be a lengthy process which is cumbersome and time consuming. Generally, the hand wrap is wrapped between the fingers maintaining the fingers at an evenly spaced position. The hand wrap acts to prevents the knuckles from becoming distorted or smashed and acts as a shock absorber on inconsistent or uneven hits. However, without adequate finger and knuckle protection, the base of the fingers become bruised and swollen, even after a light exercise, potentially resulting in future problems such as arthritis.

Therefore, a need exists to overcome the problems with the prior art as discussed above.

SUMMARY OF THE INVENTION

The invention provides a padded double-strap hand wrapping apparatus and method of wrapping the hands that overcomes the hereinafore-mentioned disadvantages of the heretofore-known hand wraps and methods of this general type and that helps prevent injury to the knuckle, hand, and wrist areas, resulting in a convenient yet supportive and protective hand wrap which can be used in conjunction with boxing and bag gloves. The hand wrapping apparatus is operable by wrapping the knuckles inside a resilient wrap body having a padded insert fabricated from a deformably resilient material; inserting each finger inside a correspondingly sized finger retention member; and wrapping the wrist, knuckles, wrap body, and finger retention members with two independent straps that attach at their ends to the wrap body.

In some embodiments, the apparatus comprises a resilient wrap body that is sized and shaped to superimpose the knuckles. The wrap body is defined by a fabric material having an upper surface, and a lower surface opposing the upper surface. The upper and lower surfaces encapsulate a resilient wrap body cavity with a padded insert disposed therein. The wrap body is further defined by an upper end and a lower end opposing the upper end.

In some embodiments, the apparatus comprises a plurality of finger retention members directly coupled to the upper end of the wrap body. The finger retention members are sized to receive a corresponding finger.

In some embodiments, the apparatus comprises a left strap of an elongated shape. The left strap has a left proximal end directly coupled to the wrap body, a left distal end, a left bottom surface, a left top surface opposing the left bottom surface, and a left strap length separating the left proximal end and the left distal end of the left strap.

Further, the left strap has a first left strap fastener disposed proximal to the left distal end of the left strap and on the left bottom surface of the left strap. The left strap may also have a second left strap fastener disposed on the upper surface of the wrap body and operably configured to directly couple with and retain the first left strap fastener.

In some embodiments, the apparatus comprises a right strap of an elongated shape. The right strap is disposed orthogonally to the left strap, such that the straps are oriented 90° apart in an unwrapped position. The right strap is defined by a right proximal end directly coupled to the wrap body, a right distal end, a right bottom surface, a right top surface opposing the right bottom surface, and a right strap length separating the right proximal end and the right distal end of the right strap.

Further, the right strap has a first right strap fastener disposed proximal to the right distal end of the right strap and on the right bottom surface. The right strap may also have a second right strap fastener disposed on the upper surface of the wrap body and operably configured to directly couple with and retain the first right strap fastener.

In accordance with another feature, an embodiment of the present invention includes a hand wrap that protects the knuckles, fingers, and wrists from injury; and can be used with boxing gloves.

In accordance with a further feature of the present invention, the padded insert comprises a deformably resilient material.

In accordance with a further feature of the present invention, the deformably resilient material comprises a gel material.

In accordance with a further feature of the present invention, the wrap body further comprises a flap, including the upper surface of the resilient wrap body, operably configured to have a first position along a flap translation path encapsulating the resilient wrap body cavity and a second position along the flap translation path defining a resilient wrap body opening spatially coupled to the resilient wrap body cavity to enable removal and entry of the padded insert.

In accordance with a further feature of the present invention, the left and right strap fasteners, respectively, are of a hook-and-loop configuration.

In accordance with a further feature of the present invention, the wrap body further comprises a left wrap body side and right wrap body side opposing the left wrap body side. Further, the left proximal end of the left strap is directly coupled to the left wrap body side, and the right proximal end of the right strap is directly coupled to the lower end of the resilient wrap body.

In accordance with a further feature of the present invention, the wrap body further comprises an unwrapped position along a hand wrapping path with the left and right straps operably configured to be disposed in a substantially perpendicular orientation with respect to one another.

In accordance with a further feature of the present invention, the wrap body and left and right straps are operably configured to be substantially planar in the unwrapped position along the hand wrapping path.

In accordance with a further feature of the present invention, the left and right strap lengths are at least 18 inches in length.

In accordance with a further feature of the present invention, the plurality of finger retention members comprises four finger retention members.

In accordance with a further feature of the present invention, the plurality of finger retention members have an annular shape and form loop shapes with areas of 3 $in^2$, 2.8 $in^2$, 2.6 $in^2$, and 2.4 $in^2$.

In accordance with a further feature of the present invention, the finger retention members are color-coordinated.

In accordance with the present invention, a method for wrapping the hands with a padded double-strap hand wrapping apparatus, comprises an initial Step of providing a hand wrapping apparatus comprising, a resilient wrap body having an upper surface and a lower surface forming a cavity, and further having a plurality of finger retention members, and further having a left and right strap joined to the wrap body in an orthogonal relationship.

Another Step comprises inserting a padded insert in the cavity of the wrap body.

The method may further comprise a Step of orienting the upper or lower surface of the wrap body to the dorsum of the hand.

A Step includes passing the fingers through the finger retention members, whereby each finger has a correspondingly sized retention member.

In some embodiments, a Step comprises aligning the knuckles with the padded insert.

A Step includes wrapping the left strap around the wrist, whereby the tautness of the left strap is controlled to achieve a desired compression.

In some embodiments, a Step may include fastening a first left strap fastener to a second left strap fastener A Step comprises wrapping the right strap between the thumb and forefinger, and around the left strap and wrap body, whereby the tautness of the right strap is controlled to achieve a desired compression.

A Step may include fastening a first right strap fastener to a second right strap fastener.

A final Step includes clenching the fists to strike a target with the padded insert, such that the padded insert engages the target.

One objective of the present invention is to provide a convenient yet supportive and protective hand wrap which can be used in conjunction with boxing and bag gloves.

Another objective is to maintain the alignment of the joints, and compresses and lends strength to the soft tissues of the hand during the impact of a punch.

Another objective is to prevent injury to the knuckle, hand, and wrist areas during boxing and martial arts related sports.

Another objective is to provide a padded insert fitted inside the upper surface of the wrap body to align with the knuckles.

Another objective is to provide a padded insert fabricated from a deformably resilient material, such as a gel, that pads the knuckles when punching a target.

Another objective is to provide left and right straps that can be pulled to a desired tautness, so as to achieve a desired compression of the wrap body around the hand.

Another objective is to provide finger retention members that are sized for a corresponding finger, so as to create a snug fit.

Another objective is to provide first and second strap fasteners that comfortably and detachably retain the wrap body around the wrist.

Another objective is to provide a hand wrap better suited for the consumer involved in combative and recreational forms of boxing and martial arts which is more convenient and easy to use than the traditional long cloth hand wrap.

Another objective is to provide a hand wrap that is easy to don on the hands.

Although the invention is illustrated and described herein as embodied in a Padded Double-Strap Hand Wrapping Apparatus and Method of Wrapping the Hands, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the left and right straps.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

FIGS. 4A and 4B are top views of the padded double-strap hand wrapping apparatus in an unwrapped position, showing the left and right straps orthogonally disposed to each other, wherein FIG. 4A shows the bottom surface of the straps and wherein FIG. 4B shows the upper surface of the straps and the bottom surface of one of the straps in accordance with the present invention;

FIG. 10A shows the dorsal part of the hand oriented to the upper surface, and the fingers passing through their respective finger retention members, FIG. 10B shows the left strap wrapping around the wrist, FIG. 10C shows the right strap wrapping between the thumb and forefinger, FIG. 10D shows the right strap wrapping around the wrist, FIG. 10E shows the right strap wrapping around the left strap, and FIG. 10F shows a user's first clenched with the hand wrapping apparatus fully wrapping the hand, in accordance with the present invention.

DETAILED DESCRIPTION

Figures 1, 2:
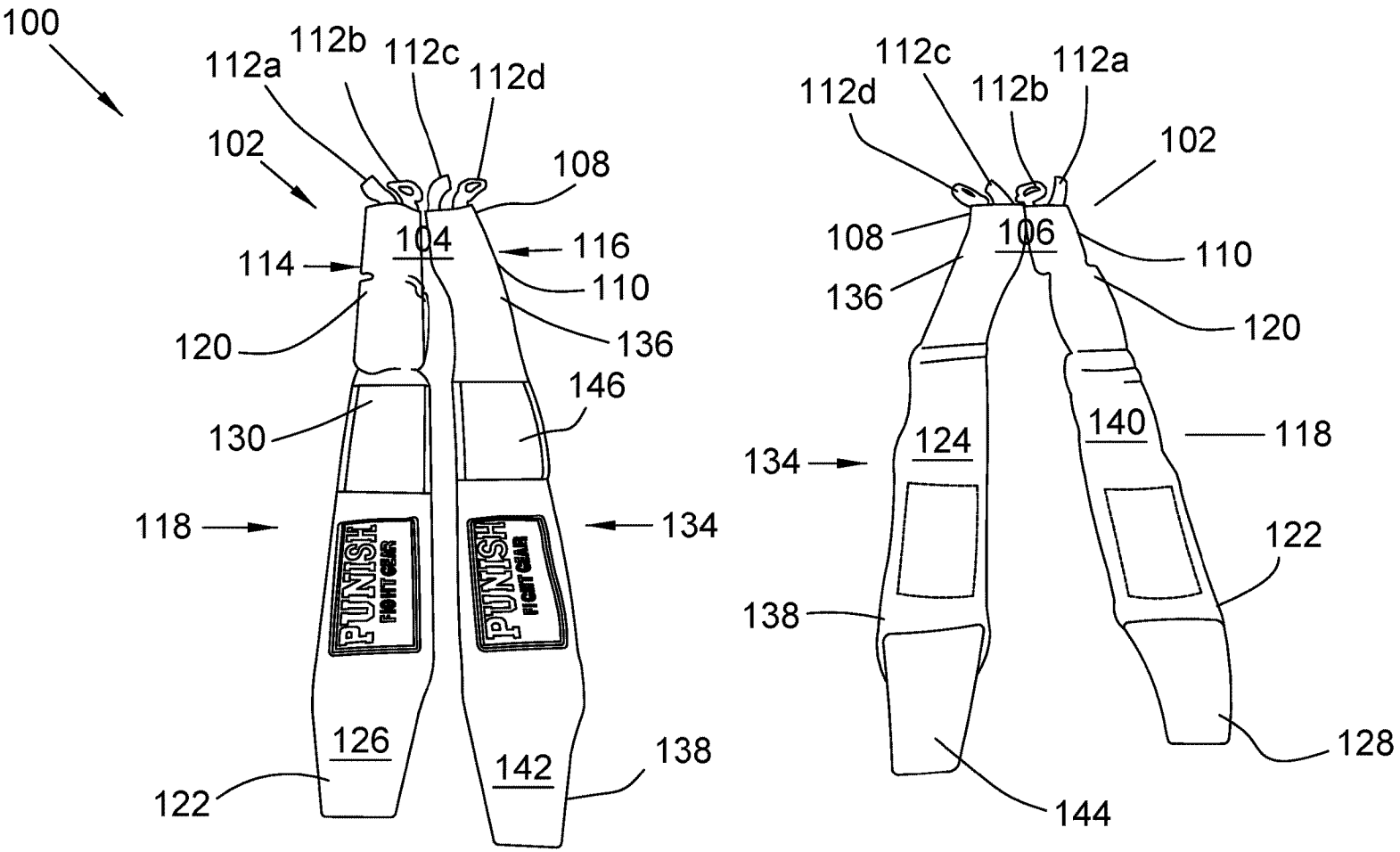
FIG. 1 is a top surface view of an exemplary padded double-strap hand wrapping apparatus, in accordance with the present invention.
FIG. 2 is a bottom surface view of the padded double-strap hand wrapping apparatus shown in FIG. 1, in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The attached figures are incorporated in and form part of the specification, and serve to further illustrate various embodiments and explain various principles and advantages all in accordance with the present inventions. Moreover, it is believed that the inventions will be better understood from a consideration of the following description in conjunction with the drawing figures, in which like reference numerals are carried forward. For purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

With reference to FIGS. 1-10F, one embodiment of a padded double-strap hand wrapping apparatus 100 and method 900 of wrapping the hand can be seen depicted. The figures will be described in conjunction with the process of wrapping and unwrapping the wrapping apparatus 100, which is also depicted in various figures. Although the figures show a specific order of executing the process steps, the order of executing the steps may be changed relative to the order shown in certain embodiments. Also, the steps shown in succession may be executed concurrently or with partial concurrence in some embodiments. Certain steps may also be omitted for the sake of brevity. In some embodiments, some or all of the process steps shown can be combined into a single process.

Referring now to FIG. 1, one embodiment of the present invention is shown in a top view. FIG. 1 shows several advantageous features of the present invention, but, as will be described below, the invention can be provided in several shapes, sizes, combinations of features and components, and varying numbers and functions of the components.

The first example of a double-strap hand wrapping apparatus 100, as shown in the top view of FIG. 1, provides a convenient, anatomically designed hand wrap and wrist support that helps to prevent injury to the knuckle, hand, and wrist areas during boxing, martial arts, and other hand-intensive sports activities. The apparatus 100 is unique in that the knuckles are snugly padded inside a resilient wrap body 102 having a padded insert 304. Further, each finger is inserted, and comfortably retained inside a correspondingly sized finger retention member 112*a-d*. In this manner, the hand wrapping apparatus 100 helps maintain the alignment of the joints, and compresses and lends strength to the soft tissues of the hand during the impact of a punch.

The wrist, knuckles, wrap body 102, and finger retention members 112*a-d* are wrapped with a left strap 118 and a right strap 134 that attach at their proximal ends to the wrap body 102. The left and right straps 118, 134 are disposed in an orthogonal relationship that allows for different areas of the hand to be wrapped, so that the wrists, fingers, and palms are wrapped to a desired compression.

Thus, the hand wrapping apparatus 100 results in a supportive and protective hand wrap which can be used in conjunction with boxing and bag gloves.

As referenced in FIG. 1, the padded double-strap hand wrapping apparatus 100, hereafter "apparatus 100", comprises a resilient wrap body 102 that is sized and shaped to superimpose the knuckles. The wrap body 102 is defined by a fabric material having an upper surface 104, and a lower surface 106 opposing the upper surface 104. The upper surface 104 is considered unitary as it is one single piece designed to be placed adjacent to the dorsum of the hand. Though in other embodiments, the lower surface 106 may be oriented to cover the dorsal of the hand. The upper and lower surfaces 104, 106 may be formed of one single piece or a combination of piece that operate as one.

Continuing with FIG. 2, the wrap body 102 comprises a left wrap body side 114 and right wrap body side 116 opposing the left wrap body side 114. As discussed below, the left and right wrap body sides 114, 116 attach to a corresponding left and right strap 118, 134. The left and right wrap body sides 114, 116, along with the upper and lower surfaces 104, 106, complete the structure of the wrap body 102, forming a cavity 302 therein. In some embodiments, the wrap body 102 is further defined by an upper end 108 and a lower end 110 that opposes the upper end 108. The lower end 110 is proximal to the wrist, while the upper end 108 is proximal to the fingers when the apparatus 100 is donned.

In some embodiments, the wrap body 102 is fabricated from a partially elastic material, i.e., fully elastic or semi-elastic material, e.g., natural rubber, cotton, spandex, or a combination. The wrap body 102 may include a substantially planar configuration, i.e., a position with minimal raised surfaces (excluding any padding employed by the wrap body 102 proximal to the plurality of finger retention members 112*a-d*).

Figure 3:
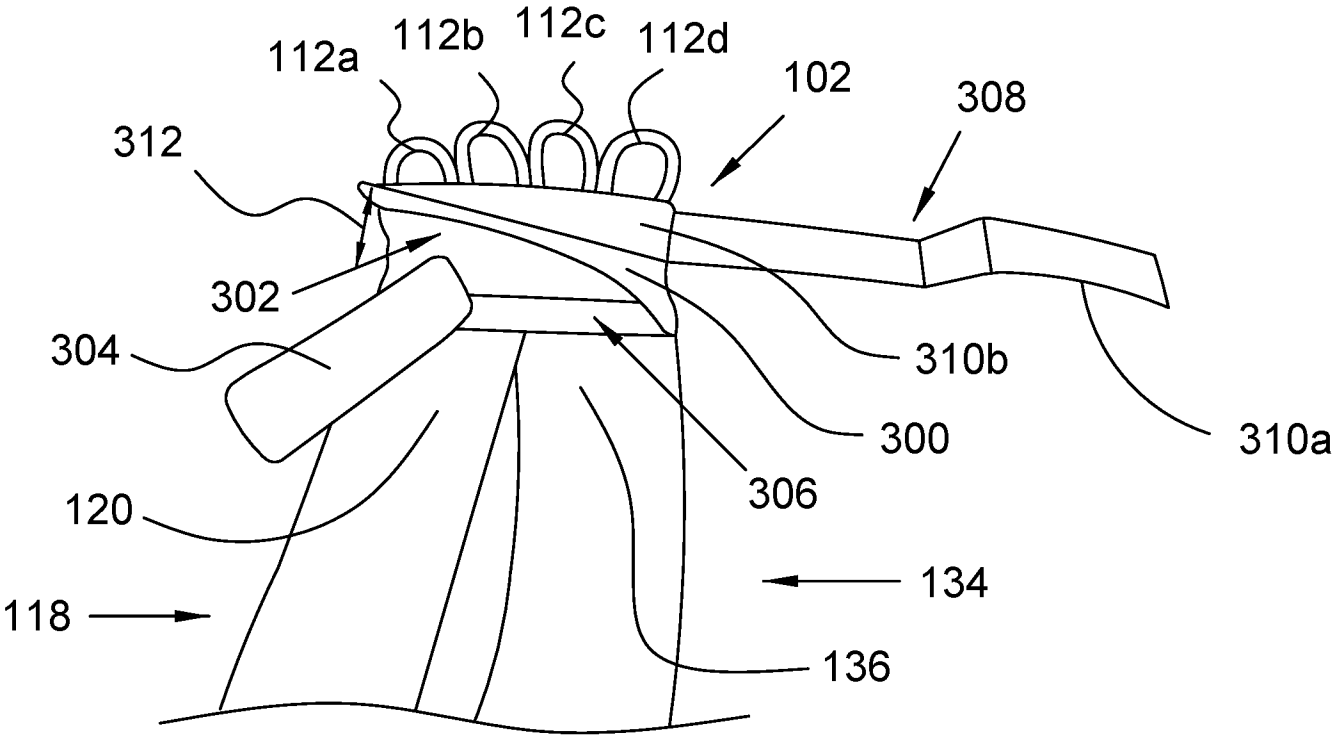
FIG. 3 is a perspective view of an exemplary resilient wrap body receiving a padded insert, and four finger retention members attached to the wrap body, in accordance with the present invention.
Figure 7:
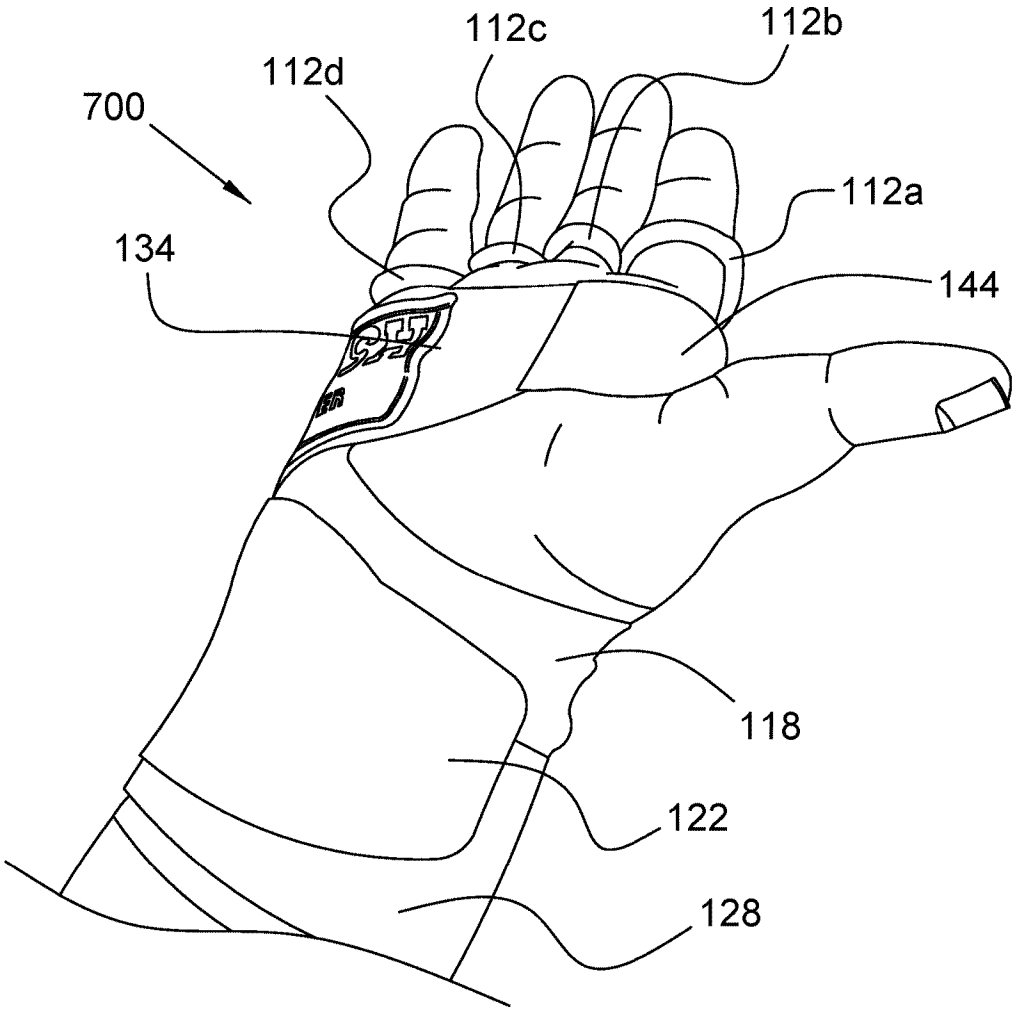
FIG. 7 is a perspective view of the padded double-strap hand wrapping apparatus in a wrapped position, showing the hand open, in accordance with the present invention.

In another embodiment of the present invention illustrated in FIG. 3, the upper and lower surfaces 104, 106 of the wrap body 102 forms a cavity 302. As illustrated in FIG. 7, the cavity 302 may be disposed at the surface of the wrap body 102 outwardly facing away from the dorsum of the hand. The cavity 302 is shaped and sized to receive a padded insert 304 of a deformably resilient material, e.g., gel, foam, having a variety of different elastomeric properties depending on the activity or purpose of the wrap.

Those skilled in the art will recognize that the padded insert 304 provides a cushion to the knuckles (and the target of the fist), thereby minimizing the risk of injury to the hand and the target, for example, in a sparring or training environment. To retain the padded insert 304 in the cavity 302, the wrap body 102 may include a first flap fastener 310*a* and a corresponding second flap fastener 310*b*.

In one embodiment, the first flap fastener 310*a* extends outwardly away from the upper surface 104 of the wrap body 102. The first flap fastener 310*a* is sized and shaped to surround and/or encapsulate the padded insert 304 and couple to a second flap fastener 310*b* of the wrap body 102 using, for example, a hook-and-loop fastening configuration.

Looking again at FIG. 3, the wrap body 102 includes a flap 300 that serves as a gateway for the cavity 302 containing the padded insert 304. The flap 300 comprises an elongated strip of material, similar to the wrap body 102. The flap 300 follows a flap translation path 312 to cover and uncover a body opening 306 that forms in the wrap body 102. The body opening 306 leads to the cavity 302 of the wrap body 102.

In one embodiment, the upper surface 104 of the wrap body 102 is operably configured to have a first position 702 along the flap translation path 312. The first position 702 allows the flap 300 to encapsulate the cavity 302, so as to retain the padded insert 304 therein. The upper surface 104 of the wrap body 102 also has a second position 308 along the flap translation path 312 defining the wrap body opening 306 that is spatially coupled to the resilient cavity 302. The second position 308 enables removal and entry of the padded insert 304 to the cavity 302. In this manner, the padded insert 304 can easily be replaced, removed, and cleaned.

Figure 6:
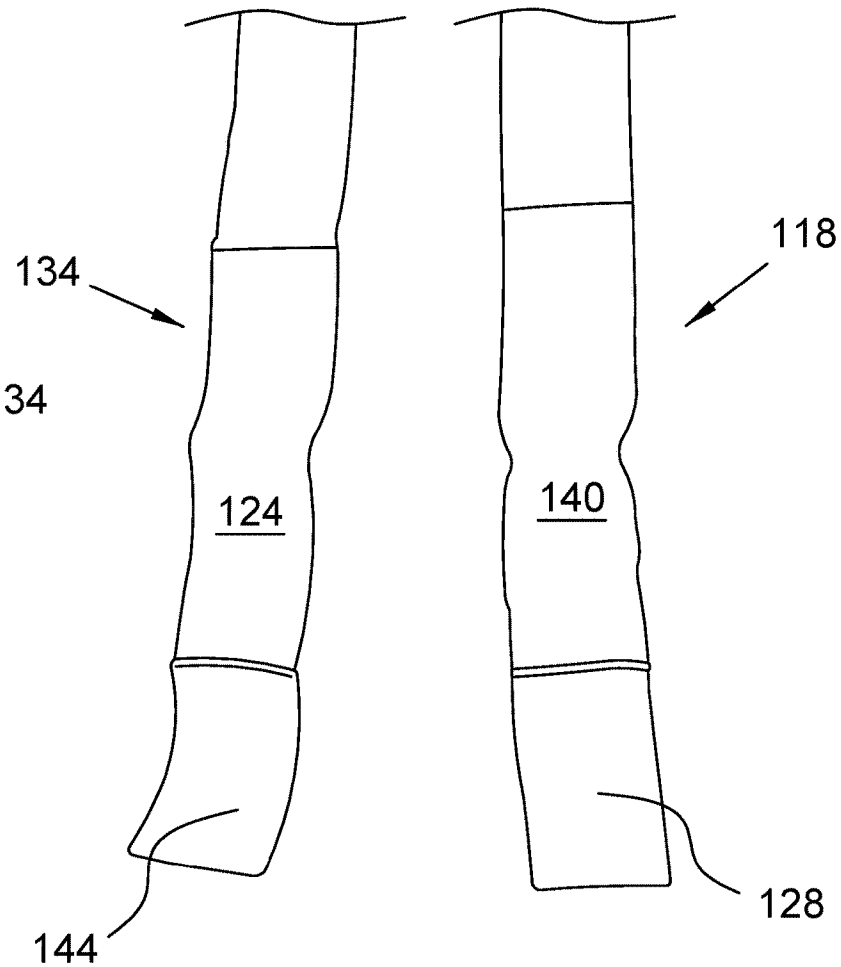
FIG. 6 is a bottom surface view of the distal end of the left and right straps, showing the respective strap fasteners, in accordance with the present invention.

As FIG. 6 illustrates, the apparatus 100 comprises a plurality of finger retention members 112*a-d* that are directly coupled to the upper end 108 of the wrap body 102. The finger retention members 112*a-d* are sized to receive a corresponding finger. In one embodiment, the plurality of finger retention members 112*a-d* comprises four finger retention members—one for each finger, but not the thumb. The finger retention members 112*a-d* are sized to correlate to the differently sized fingers.

In one embodiment, the apparatus 100 includes four finger retention members 112*a-d* configured for comfortable insertion of four fingers, excluding the thumb, whereby each retention member defined by an annular shape/loop that reduces in size to effective and efficiently convey to and guide the fingers to be inserted within each finger retention member. For example, the index, middle, ring, and little finger are to be inserted in finger retention members 112*a-d* having an aperture with areas of 3 $in^2$ (112*d*), 2.8 $in^2$ (112*c*), 2.6 $in^2$ (112*b*), and 2.4 $in^2$ (112*a*), respectively.

In one alternative embodiment, the finger retention members 112*a-d* are color-coordinated, with each color associated with a finger position. This visual aid may be useful for when donning or the wrap body 102 quickly is required. The finger retention members 112*a-d* may also be fabricated from the same material as the wrap body 102 and/or the left and right straps 118, 134. However, in other embodiments, the finger retention members 112*a-d* may be fabricated from an inelastic material. In another alternative embodiment, the packaging of the apparatus 100 may also include a cardboard cutout of a reprehensive hand to guide the user where to place the fingers.

As depicted in FIG. 1, the finger retention members 112*a-d* are directly coupled at their respective ends to the upper or lower surface 104, 106 of the wrap body 102 using, for example, stitching or adhesive. After wrapping the wrap body 102 around the fingers, the finger retention members 112*a-d* fasten to themselves using, e.g., a hook-and-loop fastening configuration, thereby stabilizing a user's finger, e.g., when jammed or injured.

Figure 4A:
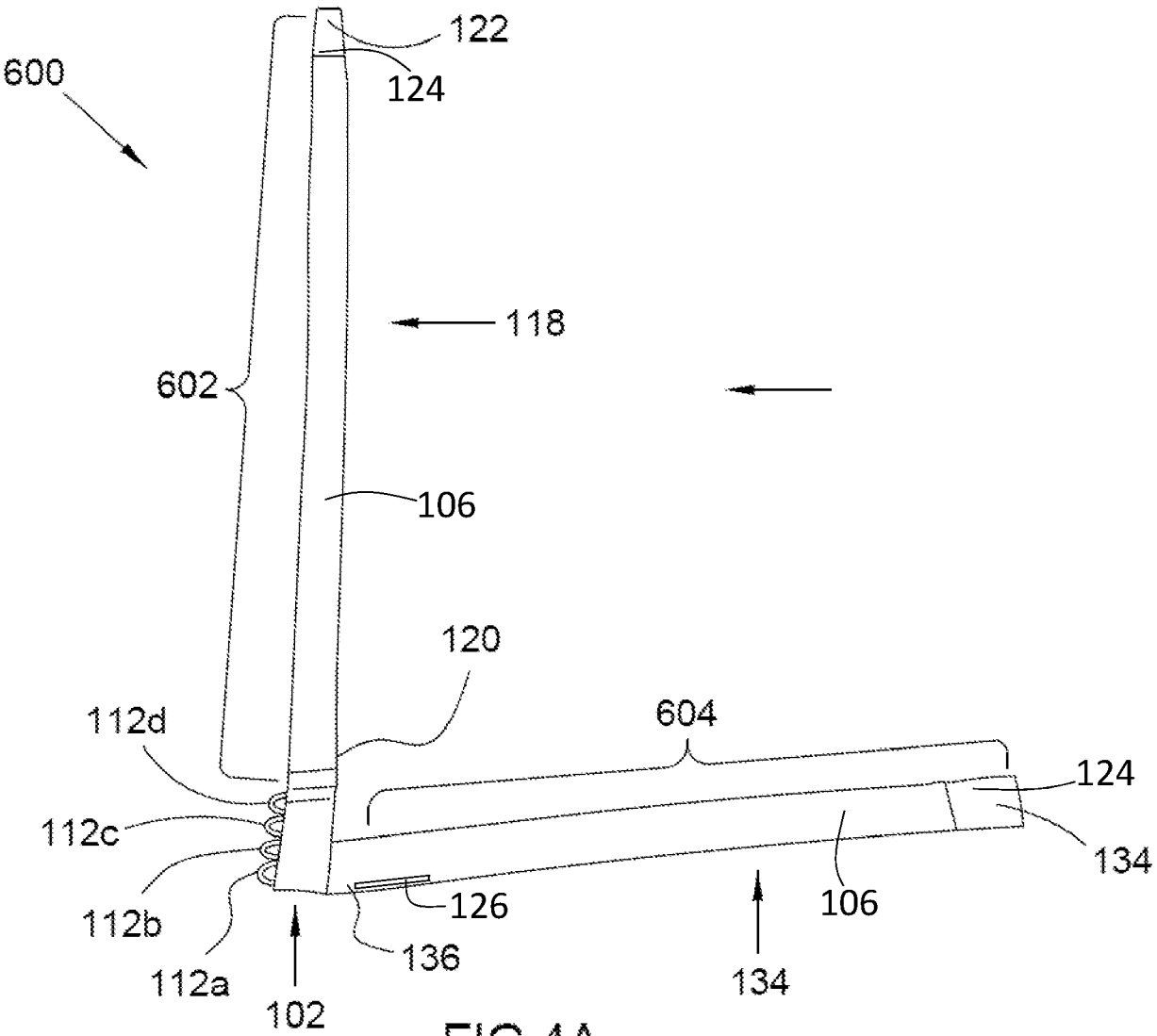
Figure 4B:
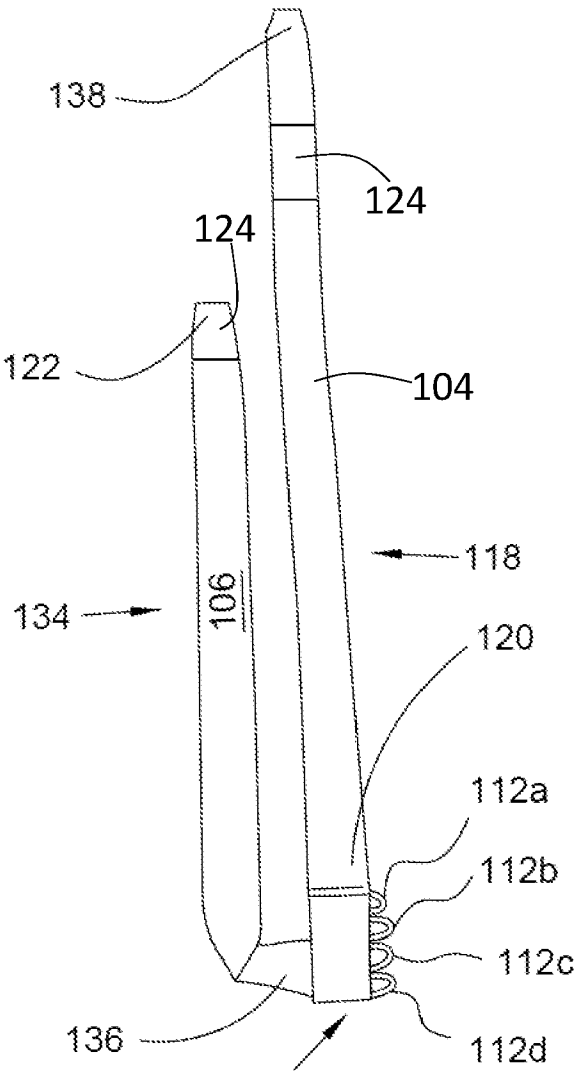

FIGS. 4A and 4B are top view of another embodiment of the apparatus 100 in an unwrapped position 600, showing the left strap 118 and the right strap 134 disposed in a substantially orthogonal configuration and orientation with respect to each other, wherein FIG. 4A shows the bottom surface 106 of the straps 118, 134, and FIG. 4B shows the upper and bottom surfaces 104, 106 of the straps 118, 134. As shown, the apparatus 100 comprises a left strap 118 of an elongated shape. However, it is significant to note that the straps may also be disposed parallel to each other, as shown in FIG. 1. In either configuration, the straps 118, 134 are configured to wrap around the hand in succession, applying a compression force to a user's hand that protects it from injuries.

In one embodiment, the left strap 118 is one of two straps 118, 134 that wrap around the hand. The left strap 118 includes a left proximal end 120 directly coupled to the left wrap body 102 side of the wrap body 102. The left strap 118 also includes a left distal free end 122, i.e., the end is not permanently coupled to anything and is operable to freely move. Said another way, the distal end 122 of the left strap 118 is "free," in that it is able to move and is uncoupled to another apparatus 100. A left strap length 602 separates the left proximal end 120 and the left distal end 122 of the left strap 118. Further, the left strap 118 has a left bottom surface and a left top surface that opposes the left bottom surface. As seen in FIGS. 4A and 4B, each of the straps 118, 134 respective include strap fasteners 124, e.g., of a hook-and-loop configuration, operably configured to directly couple and retain one another. In one embodiment, as seen in FIGS. 4A and 4B, a first left strap fastener is disposed proximal to the left distal free end 122 of the left strap and on the left bottom surface thereof. As best seen in FIG. 4B, a second left strap fastener is disposed on the upper surface of the wrap body along the left strap length. In preferred embodiments, the second left strap fastener is approximately the same length as the first strap fastener. In other embodiments, the second left strap fastener may be greater in the length than the first left strap fastener. The configurations and positions of the strap fasteners 124 in the left strap 118 may be the same or similar with regard to the right strap 134.

In some embodiments, the left strap 118 may be of a single continuous material. However, in other embodiments, the left strap 118 is formed from a combination of pieces of material. In one non-limiting embodiment, the left strap 118 and/or right strap 134 is resilient and at least approximately 18" long. In other embodiments, the strap length may be approximately 12-48 inches, may be uniform in length, and/or may be outside of said range. The left strap 118 has a left strap length 602 spanning from the proximal and distal ends 120, 122. In one embodiment, the left strap length 602 is at least twice the length of the longitudinal length of the wrap body 102 spanning from the lower end 110 of the wrap body 102 to an upper opposing end 108 of the wrap body 102 where the finger retention members 112*a-d* are coupled.

Figure 5:
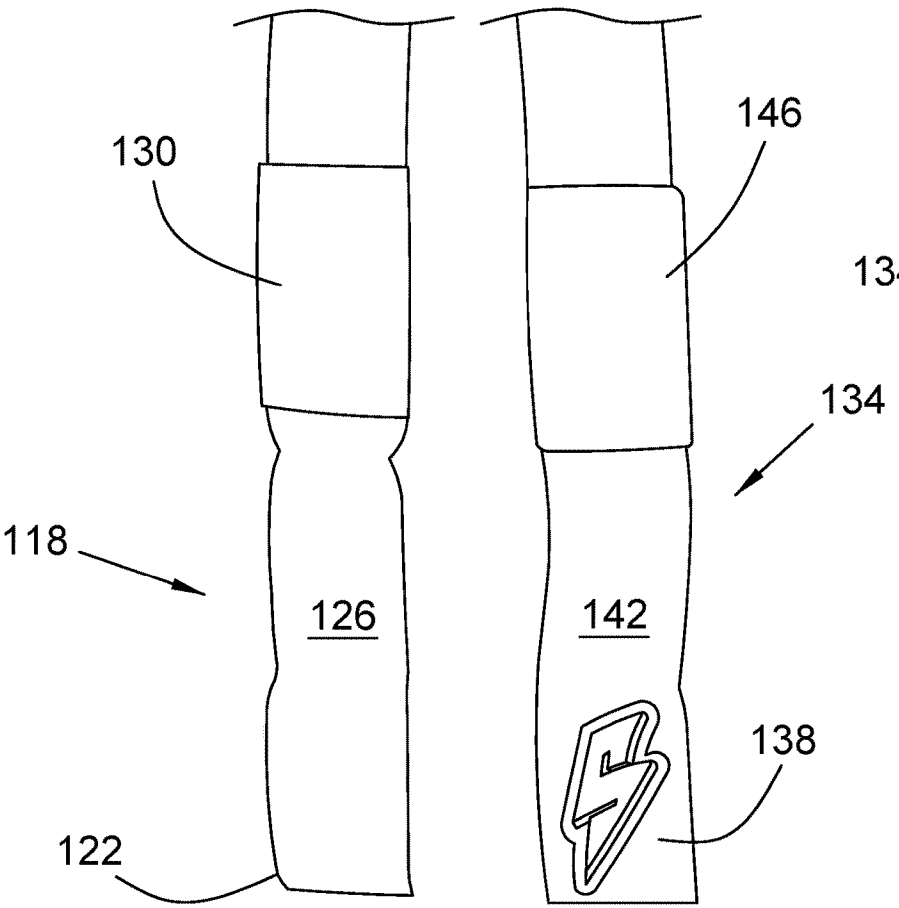
FIG. 5 is a top surface view of the distal end of the left and right straps, showing the respective strap fasteners, in accordance with the present invention.

That said, the distal end 122 has one or more strap fasteners 124 disposed at or proximal to the distal end 122 (as shown in FIGS. 5 and 6) for coupling with one or more strap fasteners 130 disposed adjacent thereto. Thus, the left strap 118 has a first left strap fastener 128 disposed proximal to the left distal end 122 of the left strap 118 and on the left bottom surface of the left strap 118.

The strap(s), preferably the right strap 134, or the body 102 may also include a thumb strap or loop 126 defining an aperture for beneficially receiving a user's thumb before the wrapping process. In other embodiments, the assembly 100 may not utilize the thumb loop 126. Beneficially, the thumb loop is orientated in the same elongated direction as the strap and may be approximately 1-3 inches in length. The thumb loop 126, along with other parts of the body 102, e.g., the insert, may be of an elastic material, e.g., neoprene. The thumb loop 126 may also be disposed proximal to the body 102.

Looking at FIG. 6, the left strap 118 also has a second left strap fastener 130 that corresponds to the first left strap fastener 128 to fasten the left strap 118 around the hand after wrapping. The second left strap fastener 130 is disposed on the upper surface 104 of the wrap body 102. In this disposition, the second left strap fastener 130 is operably configured to directly couple with and retain the first left strap fastener 128. In one non-limiting embodiment, the first and second left strap fasteners 128, 130 are of a hook-and-loop configuration. Though in other embodiments, various types of first and second left strap fasteners 128, 130 may be used, including complimentary snap buttons, a magnet, a screw, and an adhesive.

Looking again at FIGS. 5 and 6, the apparatus 100 comprises a right strap 134 defined by an elongated shape, similar to the left strap 118. The right strap 134 is disposed orthogonally to the left strap 118, such that the straps are oriented 90° apart in an unwrapped position 600. The orthogonal relationship between the straps 118, 134 allows each strap to wrap around a different section of the hand, thereby reinforcing each other around the hand.

For example, when the upper surface 104 of the wrap body 102 is oriented to the dorsal of the hand, the left strap 118 wraps around the wrist, and the right strap 134 wraps between the thumb and fore finger, and also around the left strap 118. Though this hand wrapping path 1000 is relative, and may be reversed. For example, the right strap 134 may wrap first, and the left strap 118 wrapping on top of the right strap 134. Also, to unwrap the wrap body 102, the order of wrapping the wrap body 102 around the hand/wrist can be reversed, starting with uncoupling the right strap 134 from itself; and then the left strap 118 is unwrapped accordingly. However, as discussed above, and shown in FIG. 1, the straps 118, 134 may be parallel to each other. In either configuration, the straps 118, 134 wrap around the hand.

In some embodiments, the right strap 134 is also defined by a right distal end 138 that is free. A right strap length 604 separates the right proximal end 136 and the right distal end 138 of the right strap 134. Similar to the left strap 118, the right strap 134 has a right bottom surface 140 and a right top surface 142 opposing the right bottom surface 140.

As discussed above, the wrap body 102 further includes a left wrap body side 114 and right wrap body side 116 that opposes the left wrap body side 114. The left proximal end 120 of the left strap 118 is directly coupled to the left wrap body side 114, and the right proximal end 136 of the right strap 134 is directly coupled to the lower end of the wrap body 102.

The right strap 134 may be of a single continuous material or formed from a combination of pieces of material. In one non-limiting embodiment, the right strap 134 is resilient and at least 18" long. Though in some embodiments, the right strap 134 may also be incongruent in length to the left strap 118. The right strap 134 has a right strap length 604 spanning from the proximal and distal ends 136, 138, wherein in one embodiment the strap length 604 is at least twice the length of the longitudinal length of the wrap body 102 spanning from the lower end 110 to the upper opposing end 108 of the wrap body 102.

Further, the right strap 134 has a first right strap fastener 144 and a corresponding second right strap fastener 146 to fasten the right strap 134 around the hand after wrapping. The first right strap fastener 144 is disposed proximal to the right distal end 138 of the right strap 134 and on the right bottom surface 140. The right strap 134 may also have a second right strap fastener 146 disposed on the upper surface 104 of the wrap body 102 and operably configured to directly couple with and retain the first right strap fastener 144. In one non-limiting embodiment, the right strap fasteners 144, 146 are of a hook-and-loop configuration. Though in other embodiments, various types of fasteners may be used, including complimentary snap buttons, a magnet, a screw, and an adhesive.

As shown in the figures, the left and right straps 118, 134 are sewn together along their respective side edges using, for example, threading to form the wrap body 102. The two independently mobile straps 118, 134 are joined at their respective proximal ends 120, 136 to the lower end 110 of the wrap body 102. The distal ends of the straps 118, 134 are considered "mobile" in that they are free to move or move freely when desired by the user for wrapping around the hand and/or wrist.

Figure 8:
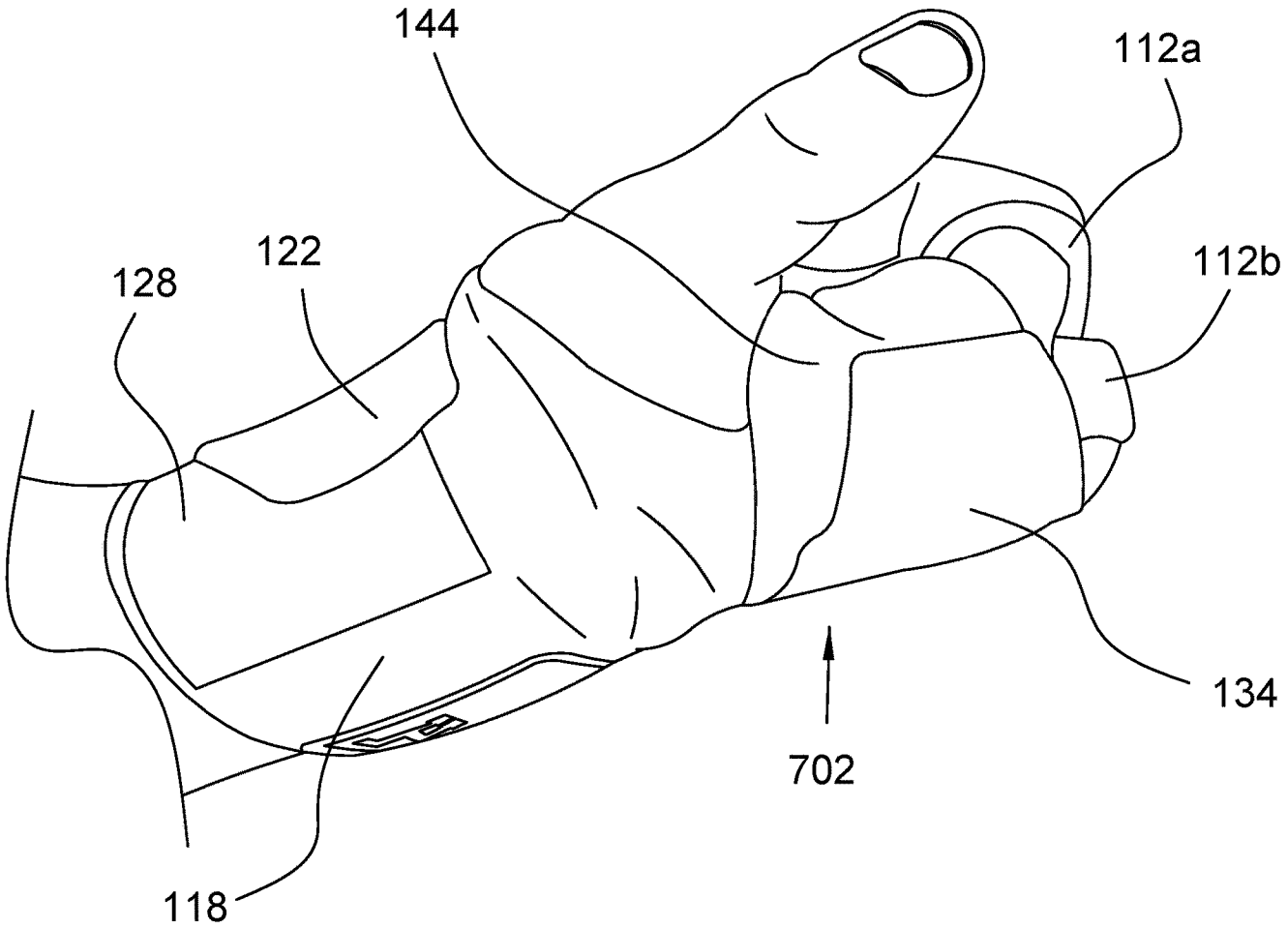
FIG. 8 is a perspective view of the padded double-strap hand wrapping apparatus in a wrapped position, showing the first clenched to strike a target with the padded insert, in accordance with the present invention.

As illustrated in FIG. 7, the wrap body 102 forms a wrapped position 700 in which the hand is fully wrapped and covered by the wrap body 102, the finger retention members 112*a-d*, and the left and right straps 118, 134, so as to enable operational activity with the apparatus 100. The wrapped position 700 forms along a hand wrapping path 1000 in which the left and right straps 118, 134 wrap around the wrist and fingers; the padded insert 304 aligns with the knuckles, and the finger retention members 112*a-d* receive a correspondingly sized finger. In the wrapped position 700, the straps 118, 134 compress the hand, and the first clenches around the wrap body 102 with the padded insert 304 oriented towards a target, and (FIG. 8).

However in another embodiment shown in FIG. 4A, the wrap body 102 has an unwrapped position 600; whereby the apparatus 100 is not operational. In the unwrapped position 600, the straps 118, 134 are disposed orthogonally to each other, and form a planar configuration. The unwrapped position 600 follows along the hand wrapping path 1000 with the left and right straps 118, 134 operably configured to be disposed in a substantially perpendicular orientation with respect to one another.

As illustrated in FIG. 4B, the straps 118, 134 and wrap body 102 are operably configured to be substantially planar when laid flat on a surface and/or placed in an unflexed/planar configuration in the unwrapped position 600. Further, the resilient configuration of the straps 118, 134 allows them to be rolled up for stowage. In some embodiments, the straps 118, 134 may also define a slit that spans from the distal ends 122, 138 of the straps to the portion of wrap body 102 in which lower end 110 of the wrap body 102 are directly coupled (also referred to as a "joint").

In one embodiment, the length of the left strap 118 is in the range of 6-12 feet and the length of the right strap 134 is in the range of 3-6 feet, as in some embodiments it is preferred to have additional material to support the wrist. In other embodiments of the hand wrapping path 1000, shown in FIGS. 10A-10E, the straps 118, 134 have substantially equal lengths. In one exemplary use, the left strap 118 is beneficially wrapped around the hand or wrist and then coupled to itself. Thereafter, the right strap 134 is then wrapped around portions of the hand and/or wrist until a desired amount of compression is reached.

Figure 10C:
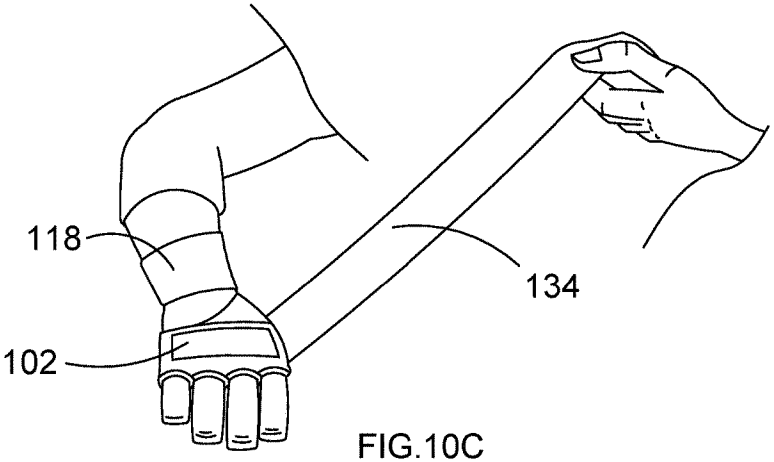
FIGS. 10A-10F are perspective views of an exemplary hand wrapping path followed to wrap the hand wrapping apparatus around the hand, where
Figure 10D:
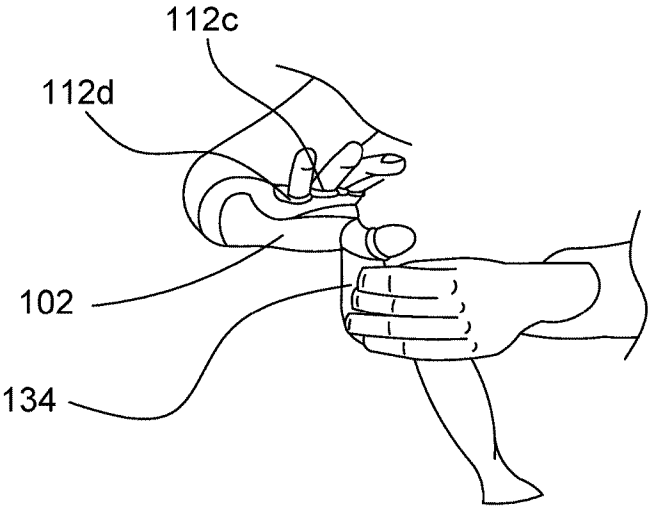
Figure 10A:
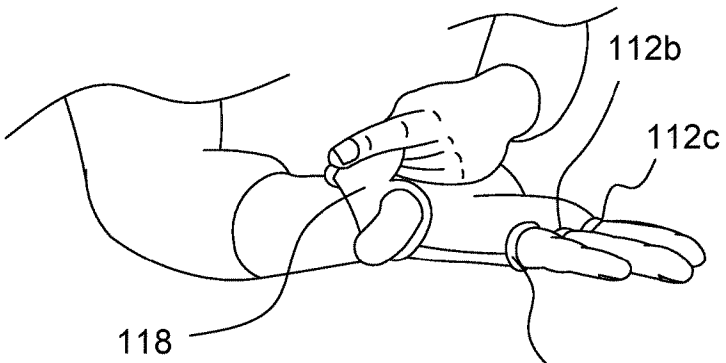

To begin the hand wrapping path 1000, the fingers are inserted through the finger retention members 112*a-d* and the upper or lower surfaces 104, 106 of the wrap body 102 are positioned against the dorsum of the hand (FIG. 10A). In other embodiments, the upper or lower surfaces 104, 106 of the wrap body 102 may be placed against the palm. Thereafter, the left and right strap 118, 134 wrap around the wrist/hand as desired (FIG. 10B), forming a variety of different wrapping configurations as those of skill in the art will appreciate.

Figure 10B:
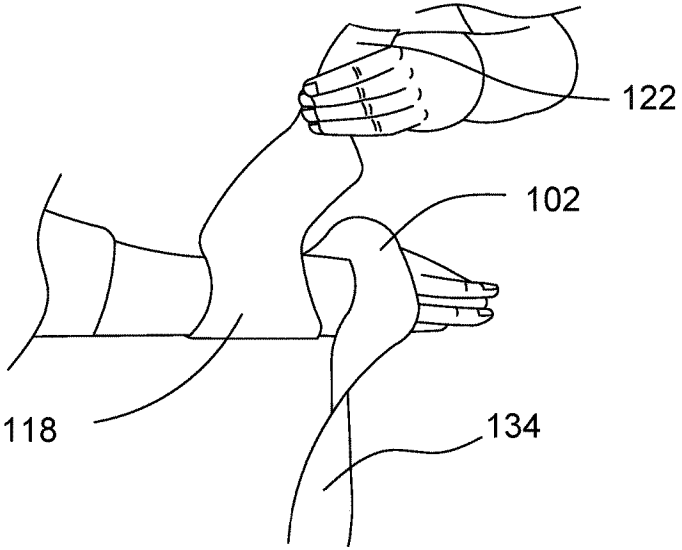
Figure 10F:
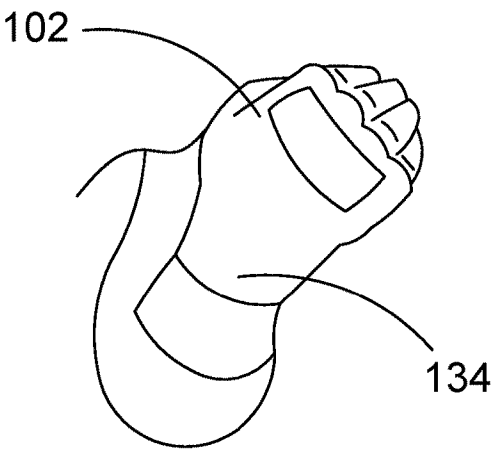
Figure 10E:
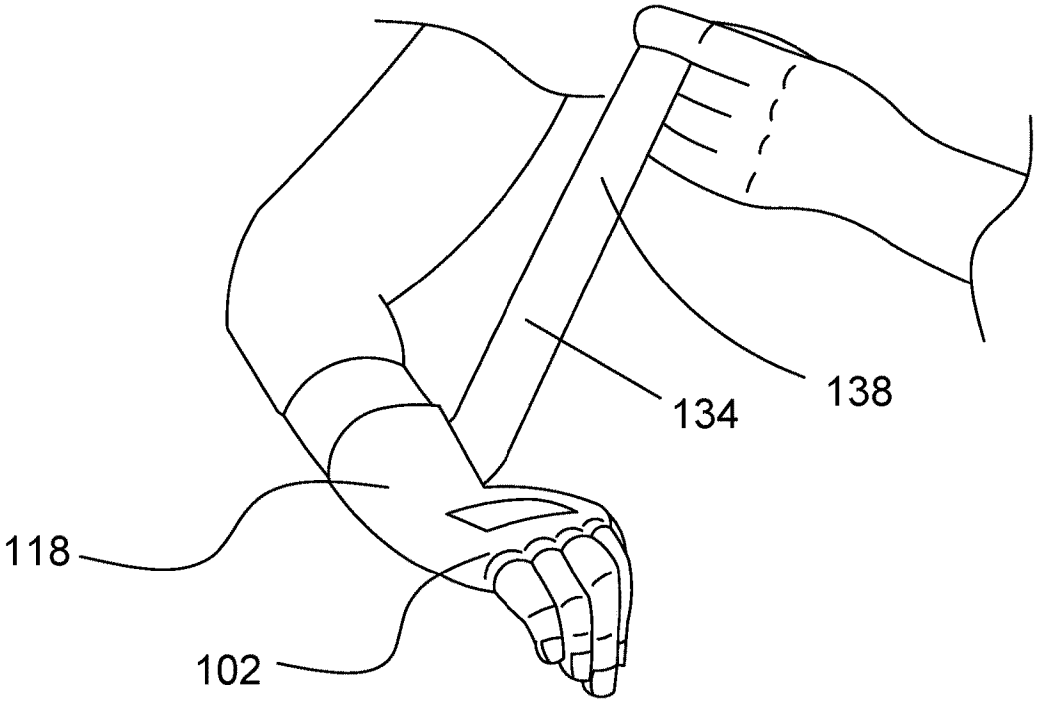

As discussed above, the orthogonal relationship between the straps 118, 134 allows each strap 118, 134 to wrap around a different section of the hand. For example, when the upper surface 104 of the wrap body 102 is oriented to the dorsal of the hand, the left strap 118 wraps around the wrist (FIG. 10C), and the right strap 134 wraps between the thumb and forefinger, and around the left strap 118 (FIGS. 10D and 10E). Though these wrapping orders are relative, and may be reversed. Once fully wrapped, the first is clenched with the padded insert 304 oriented towards a target, such that the padded insert 304 engages the target (FIG. 10F).

Figure 9:
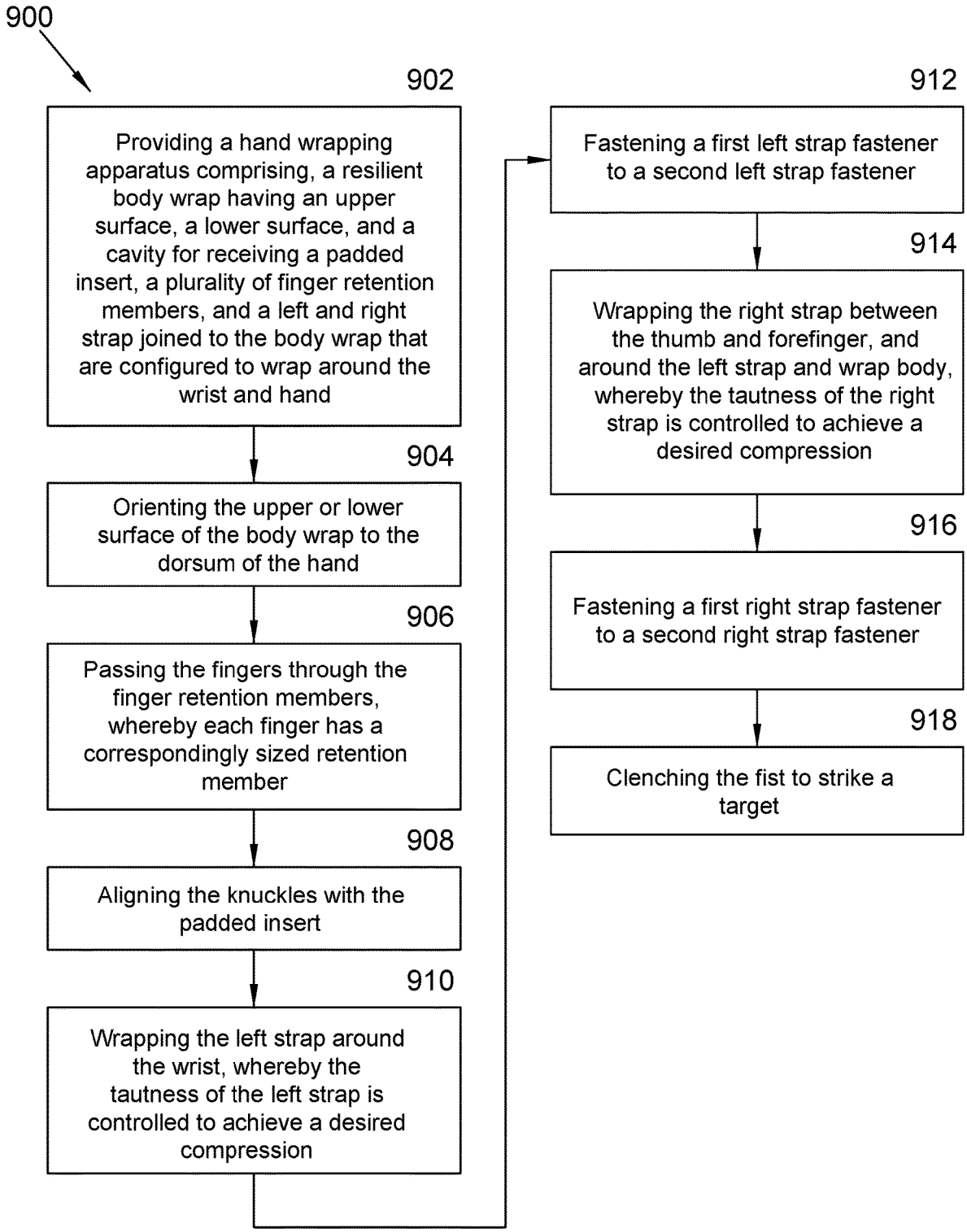
FIG. 9 is a flowchart of an exemplary method for wrapping the hands with a padded double-strap hand wrapping apparatus, in accordance with the present invention.

FIG. 9 will be described in conjunction with the process images of FIGS. 10A-10F. Although FIG. 9 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted for the sake of brevity. In some embodiments, some or all of the process steps included in FIG. 9 can be combined into a single process.

In accordance with the present invention, a method 900 for wrapping the hands with a padded double-strap hand wrapping apparatus, comprises an initial Step 902 of providing a hand wrapping apparatus comprising, a resilient wrap body having an upper surface and a lower surface forming a cavity, and further having a plurality of finger retention members, and further having a left and right strap joined to the wrap body in an orthogonal relationship.

The method 900 may further comprise a Step 904 of inserting a padded insert in the cavity of the wrap body. The padded insert 304 provides a cushion to the knuckles (and the target of the fist), thereby minimizing the risk of injury to the hand and the target, for example, in a sparring or training environment. To retain the padded insert 304 in the cavity 302, the wrap body 102 may include a first flap fastener 310*a* and a corresponding second flap fastener 310*b*.

As referenced in FIG. 10A, a Step 906 may include orienting the upper or lower surface of the wrap body to the dorsum of the hand. A Step 908 includes passing the fingers through the finger retention members, whereby each finger has a correspondingly sized retention member. Each finger is inserted, and comfortably retained inside a correspondingly sized finger retention member 112*a-d*. In some embodiments, a Step 910 comprises aligning the knuckles with the padded insert. FIG. 10B shows a Step 912 of wrapping the left strap around the wrist, whereby the tautness of the left strap is controlled to achieve a desired compression.

In some embodiments, a Step 914 may include fastening a first left strap fastener to a second left strap fastener. The strap fasteners 128, 130 detachably couple to fasten the left strap 118 around the hand after wrapping. Turning now to FIG. 10C, a Step 916 comprises wrapping the right strap between the thumb and forefinger, and around the left strap and wrap body, whereby the tautness of the right strap is controlled to achieve a desired compression.

It is significant to note that the orthogonal relationship between the straps allows each strap to wrap around a different section of the hand. For example, as FIG. 10D illustrates, when the upper surface of the wrap body is oriented to the dorsal of the hand, the right strap wraps between the thumb and fore finger, and around the left strap. The orthogonal relationship also facilitates the right strap wrapping around the left strap (FIG. 10E).

A Step 918 of the method 900 may include fastening a first right strap fastener to a second right strap fastener. The strap fasteners 144, 146 detachably couple to fasten the right strap 134 around the hand after wrapping. Turning now to FIG. 10F, a final Step 920 includes clenching the fists to strike a target with the padded insert, such that the padded insert engages the target. The apparatus 100 is unique in that the knuckles are snugly padded inside a resilient wrap body 102 having a padded insert 304.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A hand wrapping apparatus, the apparatus comprising:

a wrap body sized and shaped to superimpose the knuckles, the wrap body of a resilient fabric material having an upper surface, a lower surface opposing the upper surface, the upper and lower surfaces encapsulating a resilient wrap body cavity with a padded insert disposed therein, the wrap body having an upper end and a lower end opposing the upper end of the wrap body;

a plurality of finger retention members directly coupled to the upper end of the wrap body;

a left strap of an elongated shape, having a left proximal end directly coupled to the wrap body, a left distal free end, a left bottom surface, a left top surface opposing the left bottom surface, and a left strap length separating the left proximal end and the left distal free end of the left strap, the left strap having a first left strap fastener disposed proximal to the left distal free end of the left strap and on the left bottom surface, the left strap fastener further having a second left strap fastener disposed on the upper surface of the wrap body along the left strap length and operably configured to directly couple with and retain the first left strap fastener;

a right strap of an elongated shape, the right strap having a right proximal end directly coupled to the wrap body, a right distal end, a right bottom surface, a right top surface opposing the right bottom surface, and a right strap length separating the right proximal end and the right distal end of the right strap, the right strap having a first right strap fastener disposed proximal to the right distal end of the right strap and on the right bottom surface, the right strap further having a second right strap fastener disposed on the upper surface of the wrap body along the right strap length and operably configured to directly couple with and retain the first right strap fastener; and a flap, including the upper surface of the resilient wrap body, operably configured to have a first position along a flap translation path encapsulating the resilient wrap body cavity and a second position along the flap translation path defining a resilient wrap body opening spatially coupled to the resilient wrap body cavity to enable removal and entry of the padded insert.

2. The apparatus according to claim 1, wherein:

the padded insert comprises a deformably resilient material.

3. The apparatus according to claim 2, wherein:

the deformably resilient material comprises a gel material.

4. The apparatus according to claim 1, wherein:

the left and right strap fasteners, respectively, are of a hook-and-loop configuration.

5. The apparatus according to claim 1, wherein the wrap body further comprises:

a left wrap body side and right wrap body side opposing the left wrap body side, wherein the left proximal end of the left strap is directly coupled to the left wrap body side, and the right proximal end of the right strap is directly coupled to the lower end of the resilient wrap body.

6. The apparatus according to claim 1, wherein the wrap body further comprises:

a wrapped position along a hand wrapping path with the left and right straps wrapped around the wrist and fingers, the padded insert aligned with the knuckles, and the finger retention members receiving a correspondingly sized finger.

7. The apparatus according to claim 6, wherein the wrap body further comprises:

an unwrapped position along the hand wrapping path with the left and right straps operably configured to be disposed in a substantially perpendicular orientation with respect to one another.

8. The apparatus according to claim 7, wherein:

the wrap body and left and right straps are operably configured to be substantially planar in the unwrapped position along the hand wrapping path.

9. The apparatus according to claim 1, wherein:

the left and right strap lengths are at least 18 inches.

10. The apparatus according to claim 1, wherein:

the plurality of finger retention members comprises four finger retention members.

11. The apparatus according to claim 1, wherein:

the plurality of finger retention members form loop shapes with areas of 3 $in^2$, 2.8 $in^2$, 2.6 $in^2$, and 2.4 $in^2$.

12. The apparatus according to claim 1, wherein:

the finger retention members are color-coordinated.

13. The apparatus according to claim 1, further comprising:

a first flap fastener extending outwardly away from the upper surface of the wrap body to surround the padded insert and couple to a second flap fastener.

14. The apparatus according to claim 1, wherein:

the left strap and the right strap are oriented orthogonally to each other.

15. A hand wrapping apparatus, the apparatus comprising:

a resilient wrap body sized and shaped to superimpose the knuckles, the resilient wrap body defined by a fabric material having an upper surface, a lower surface opposing the upper surface, the upper and lower surfaces encapsulating a resilient wrap body cavity with a padded insert disposed therein, the wrap body further being defined by an upper end and a lower end opposing the upper end;

a flap, including the upper surface of the resilient wrap body, operably configured to have a first position along a flap translation path encapsulating the resilient wrap body cavity and a second position along the flap translation path defining a resilient wrap body opening spatially coupled to the resilient wrap body cavity to enable removal and entry of the padded insert;

a plurality of finger retention members directly coupled to the upper end of the wrap body;

a left strap of an elongated shape, the left strap having a left proximal end directly coupled to the wrap body, a left distal end, a left bottom surface, a left top surface opposing the left bottom surface, and a left strap length separating the left proximal end and the left distal end of the left strap, the left strap having a first left strap fastener disposed proximal to the left distal end of the left strap and on the left bottom surface, the left strap fastener further having a second left strap fastener disposed on the upper surface of the wrap body and operably configured to directly couple with and retain the first left strap fastener, the left strap fasteners comprising a hook-and-loop configuration;

a right strap of an elongated shape disposed orthogonally to the left strap, the right strap having a right proximal end directly coupled to the wrap body, a right distal end, a right bottom surface, a right top surface opposing the right bottom surface, and a right strap length separating the right proximal end and the right distal end of the right strap, the right strap having a first right strap fastener disposed proximal to the right distal end of the right strap and on the right bottom surface, the right strap further having a second right strap fastener disposed on the upper surface of the wrap body and operably configured to directly couple with and retain the first right strap fastener, the right strap fasteners comprising the hook-and-loop configuration;

whereby the apparatus is operable in a wrapped position along a hand wrapping path with the left and right straps wrapped around the wrist and fingers, the padded insert aligned with the knuckles, and the finger retention members receiving a correspondingly sized finger; and whereby the apparatus is stowable in an unwrapped position along the hand wrapping path with the left and right straps operably configured to be disposed in a substantially perpendicular orientation with respect to one another, whereby the wrap body and left and right straps are operably configured to be substantially planar in the unwrapped position along the hand wrapping path.

16. The apparatus according to claim 15, wherein:

the left and right strap lengths are at least 18 inches.

17. The apparatus according to claim 15, wherein:

the plurality of finger retention members comprises four finger retention members.

18. The apparatus according to claim 15, wherein:

the plurality of finger retention members form annular shapes with areas of 3 $in^2$, 2.8 $in^2$, 2.6 $in^2$, and 2.4 $in^2$.

* * * * *